US010969121B2

(12) United States Patent
Heinovaara

(10) Patent No.: US 10,969,121 B2
(45) Date of Patent: Apr. 6, 2021

(54) SUPPLY AIR DEVICE

(71) Applicant: Alme Solutions Oy, Tampere (FI)

(72) Inventor: Jari Heinovaara, Sarkola (FI)

(73) Assignee: Alme Solutions OY, Tampere (FI)

( * ) Notice: Subject to any disclaimer, the term of this patent is extended or adjusted under 35 U.S.C. 154(b) by 189 days.

(21) Appl. No.: 16/079,587

(22) PCT Filed: Feb. 28, 2017

(86) PCT No.: PCT/FI2017/050127

§ 371 (c)(1),
(2) Date: Aug. 24, 2018

(87) PCT Pub. No.: WO2017/158230

PCT Pub. Date: Sep. 21, 2017

(65) Prior Publication Data

US 2019/0049123 A1 Feb. 14, 2019

(30) Foreign Application Priority Data

Mar. 15, 2016 (FI) ..... 20165210

(51) Int. Cl.

| | |
|---|---|
| ***F24F 1/01*** | (2011.01) |
| ***F24F 13/26*** | (2006.01) |
| ***F24F 13/06*** | (2006.01) |
| ***F24F 11/81*** | (2018.01) |

(52) U.S. Cl.

CPC ..... *F24F 1/01* (2013.01); *F24F 11/81* (2018.01); *F24F 13/06* (2013.01); *F24F 13/26* (2013.01); *F24F 2013/0616* (2013.01); *F24F 2221/14* (2013.01); *F24F 2221/17* (2013.01)

(58) Field of Classification Search

CPC .... F24F 1/01; F24F 11/81; F24F 13/06; F24F 13/26; F24F 2013/0616; F24F 2221/14; F24F 2221/17

USPC ..... 454/237

See application file for complete search history.

(56) References Cited

U.S. PATENT DOCUMENTS

| | | | |
|---|---|---|---|
| 6,361,431 | B1 | 3/2002 | Kawano |
| 2002/0056545 | A1 | 5/2002 | Horttanainen |
| 2002/0062948 | A1 | 5/2002 | Horttanainen |
| 2002/0070010 | A1 | 6/2002 | Hakkinen |

(Continued)

FOREIGN PATENT DOCUMENTS

| | | | |
|---|---|---|---|
| CN | 1987226 | A | 6/2007 |
| DE | 29609754 | U1 | 1/1997 |

(Continued)

OTHER PUBLICATIONS

Search report of International Patent Application PCT/FI2017/050127 dated Apr. 24, 2017 by Finnish Patent and Registration Office.

(Continued)

*Primary Examiner* — Steven B McAllister
*Assistant Examiner* — Allen R Schult
(74) *Attorney, Agent, or Firm* — Berggren LLP

(57) ABSTRACT

The invention relates to a supply air device (200) comprising an outflow structure that increases air circulating efficiency of the supply air device (200). The outflow structure comprises an outflow channel structure and a nozzle structure. The outflow channel (210, 211) is arranged to be fixed in a distance from the nozzle and on a side of the supply air device (200).

16 Claims, 7 Drawing Sheets

(56) References Cited

U.S. PATENT DOCUMENTS

| | | | | |
|---|---|---|---|---|
| 2006/0213216 | A1* | 9/2006 | Sakashita | F24F 13/20 62/419 |
| 2009/0264062 | A1 | 10/2009 | Miller | |
| 2014/0034046 | A1* | 2/2014 | Warmuth | F23L 17/04 126/85 B |
| 2016/0076806 | A1* | 3/2016 | Khan | F25D 17/08 62/426 |

FOREIGN PATENT DOCUMENTS

| | | | | |
|---|---|---|---|---|
| DK | 89697 | C | | 9/1960 |
| EP | 1077350 | A1 | | 2/2001 |
| EP | 2140207 | A1 | | 1/2010 |
| GB | 1011742 | A | | 12/1965 |
| GB | 2244804 | A | | 12/1991 |
| GB | 2271175 | A | | 4/1994 |
| GB | 2413378 | A | | 10/2005 |
| JP | 59174557 | U | * | 11/1984 |
| JP | S59174557 | U | | 11/1984 |
| WO | 0242691 | A1 | | 5/2002 |
| WO | 2015107550 | A2 | | 7/2015 |

OTHER PUBLICATIONS

Office action of Finnish Patent Application No. 20165210 dated Oct. 6, 2016 by Finnish Patent and Registration office.

* cited by examiner

SUPPLY AIR DEVICE

PRIORITY

This application is a U.S national application of the international application number PCT/FI2017/050127 filed on 28 Feb. 2017, which claims priority of Finnish patent application FI20165210 filed on Mar. 15, 2016, the contents of all of which are incorporated herein by reference.

TECHNICAL FIELD

The present invention relates to a supply air device comprising an outflow structure directing a supply air flow into a room. The supply air flow comprises primary air and secondary air. The primary air flow entrains a flow of secondary air from the room to flow to the supply air device and further to return to the room.

BACKGROUND

For temperature controlling of rooms, it has become common to provide the rooms with supply air devices, wherein primary air supplied from a central ventilation system is blown from nozzles inside the supply air device to be mixed in a discharge structure with a secondary air flow from the room entrained by the supply air flow. The air mixture formed by the primary and secondary air is led from the supply air device into the room as the supply air flow. The secondary air entrained from the room enters the supply air device via a temperature controlling device which enables the temperature controlling of the secondary air. This kind of supply air device controls internal thermal conditions of the room.

In some cases the secondary air is led instead of or in addition to a temperature controlling device through a filter in order to remove impurities from indoor air. The filter causes a flow resistance, which is not advantageous for the function of the supply air device. The flow resistance reduces the amount of secondary air flow, wherein the filtered secondary air flow does not have a significant effect on the quality of indoor air or temperature of indoor air, when the supply air device comprises a temperature controlling device. In other words, the filter of the supply air device restricts the secondary air flowing through the filter, resulting in an excessive reduction in removing impurities and in the temperature controlling efficiency of the supply air device comprising the temperature controlling device.

By increasing the primary air flow of the central ventilation system, it may be possible to increase the secondary air flow and therefore air purification and/or temperature controlling that is cooling or heating. However, among other things, increasing the primary air flow increases energy consumption and may lead to a need for bigger structures for the air flows of the central ventilation system. Increase of the primary air flow can also increase the size of the ventilation system, for example, size of air ducts and/or air handling units.

SUMMARY

It is an aim of the present invention to provide a supply air device comprising an outflow structure that increases air circulating efficiency (secondary air flow (litres/second (l/s))/primary air flow (l/s)) of a supply air device. The outflow structure comprises an outflow channel structure comprising at least one outflow channel and a nozzle structure comprising at least one nozzle. The outflow channel is arranged to be fixed in a distance from the nozzle and on a side of the supply air device.

According to a first embodiment, there is provided a supply air device comprising an outflow structure comprising a nozzle structure and an outflow channel structure, wherein the nozzle structure comprises a plurality of nozzles which are arranged to the bottom of the supply air device for supplying primary air. The outflow channel structure comprises an outflow channel, a first end of which is arranged in a first distance from said plurality of nozzles so that a mixing chamber is formed between said plurality of nozzles and the first end of the outflow channel and so that said plurality of nozzles supply the primary air towards the first end of the outflow channel and in a second distance from the side of the supply air device. The second end of the outflow channel is arranged outside the supply air device. The primary air entrains secondary air from outside the supply air device to flow to the mixing chamber to be mixed with the primary air in the mixing chamber before the primary air and the secondary air enter the outflow channel through the first end of the outflow channel and flow out of the supply air device through the second end of the outflow channel.

According to an embodiment, the second end of the outflow channel is turned away from the supply air device. According to an embodiment, the second end of the outflow channel is directed downwards. According to an embodiment, the outflow channel is a uniform and unobstructed structure perpendicular to the air flowing direction in the outflow channel. According to an embodiment, the cross-sectional area which is perpendicular to the air flow of the outflow channel remains constant. According to an embodiment, the second end of the outflow channel is wider in the vertical direction and narrower in the horizontal direction than the first end of the outflow channel. According to an embodiment, the outflow channel structure comprises an outflow channel for each side of the supply air device. According to an embodiment, the nozzle structure is a nozzle channel structure arranged in a distance from the bottom of the supply air device forming a circulation space between the bottom of the supply air device and the nozzle channel structure. According to an embodiment, the nozzle structure comprises a plurality of nozzles arranged to the bottom of the supply air device. According to an embodiment, the supply air device further comprises a filter. According to an embodiment, the supply air device comprises two or more nozzle channel structures with separate outflow channel structures.

BRIEF DESCRIPTION OF THE DRAWINGS

In the following, various embodiments of the invention will be described in more detail with reference to the appended drawings, in which.

DETAILED DESCRIPTION

Figure 1:
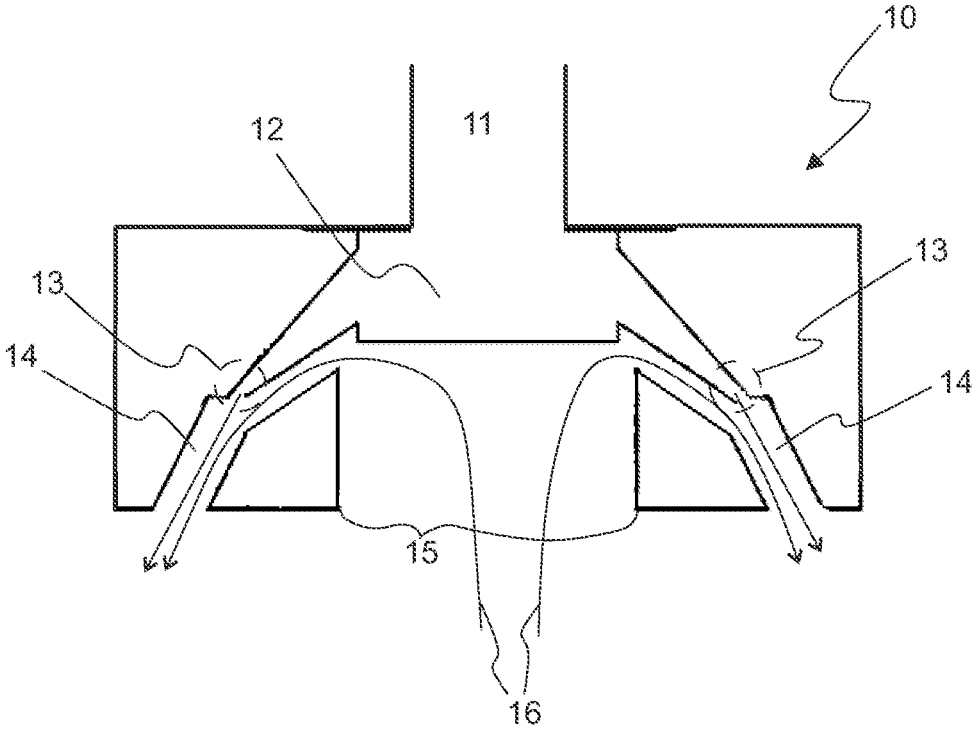
FIG. 1 shows a cross-sectional view of a prior art supply air device.

A supply air device according to the invention that is arranged to be fixed to a ceiling or wall comprises an outflow structure. The term supply air device covers in this context also, for example, local exhaust ventilation devices and air purifiers in addition to supply air devices. The outflow structure of the supply air device comprises a nozzle structure for supplying primary air and an outflow channel structure for supplying primary air and secondary air to a room. The air supplied by nozzles of the nozzle channel structure of the supply air device is called primary air. The primary air may be received, for example, from the central ventilation system or from the same room, from some other space/room or from outdoors by using a separate fan. At the same time, secondary air is drawn back into the supply air device to be mixed with primary air and to be supplied to the room through outflow channels. The outflow structure arrangement according to the invention increases the air circulating efficiency (secondary air flow (litres/second (l/s))/primary air flow (Us)) of a supply air device and thereby enhances the purification or temperature controlling of air in the room, if the supply air device is also equipped with a filter and/or a temperature controlling device. The filter causes a flow resistance, which reduces the amount of secondary air flow. If an amount of secondary air decreases, the filtered secondary air flow may not have a significant effect on the quality or temperature of indoor air.

The nozzle structure may be a plurality of separate nozzles arranged traditionally to the bottom of the air supply device for supplying primary air. The sides of the supply air device may extend directly perpendicular in respect to the bottom. The number of nozzles, the diameter and shape of nozzles, the locations of nozzles at the bottom of the supply air device and/or the distance between nozzles may be selected to be suitable for the purpose of the supply air device. The nozzles may be arranged, for example, in a line or the like next to one or more sides. The bottom of the supply air device is the side of the supply air device that is against the first end of an outflow channel(s) through which air flows from the supply air device to the room. The bottom of the supply air device is arranged to be fixed towards the ceiling or wall when the supply air device is fixed to the ceiling or wall.

Alternatively the nozzle structure may also be a nozzle channel structure that is a peripherally closed duct system, as separate ducts forming a duct system or as a duct system comprising at least two separate duct sections. The sections may be connected together, for example, by connecting parts or the duct system may comprise at least two separate duct sections in which case a closed duct system is divided into at least two separate duct sections by a compartmentation wall(s). The nozzle channel structure may have various shapes. It may have, for example, a shape of a hollow rectangle with or without round corners, toroid, hollow oval or any other suitable shape when the supply air device is fixed to a ceiling or wall of a room and seen from below. The nozzle channel structure comprises a plurality of nozzles that are perforations with or without collars arranged on the perimeter of the nozzle channel structure in a distance from each other. The number of nozzles, the diameter and shape of nozzles, the locations of nozzles relative to the longitudinal line of one or more parts of the nozzle channel structure and/or the distance between nozzles may be selected to be suitable for the purpose of the supply air device. It is also possible that the location or the diameter or the shape of nozzle perforations or the distance between nozzles of the same nozzle channel structure vary. It is also possible that instead of a plurality of nozzles there is one long nozzle, for example, a slit nozzle. The nozzle channel structure may be made, for example, of metal or other suitable material. Ducts or parts of nozzle channel structures may have different cross-sections. A cross-section of duct(s) or part(s) of a nozzle channel structure may be circular, rectangular or an oval shape etc. Furthermore, cross-sections of ducts/parts of one nozzle channel structure may vary. For example, one or more part(s) of a nozzle channel structure may have rectangular shape and one or more other part(s) of the same nozzle channel structure may have circular shape. The nozzle channel structure may be formed from a uniform channel or channel modules with a monolithic profile, which channel modules are configured to be fastened, for example, one after the other, so that each nozzle channel module constitutes a part of the nozzle channel structure. Inside the supply air device, the nozzle channel structure is arranged in a distance from a bottom of the supply air device, but still in the bottom of the supply device. When the nozzle channel structure is arranged in a distance from the bottom of the supply air device, it may increase entrainment of the secondary air by enabling circulating of the secondary air from a first side (a center side) of the primary air flow to the other side of the primary air flow through the circulating space between the bottom of the supply air device and the nozzle channel structure, wherein the other side is between the primary air flow and an outer wall of a discharge channel of the supply air device. By the nozzle channel structure the amount of secondary air may be increased and the quality and/or temperature of indoor air can be kept on an effective level.

It should be noted that even if nozzles are arranged in the bottom or in a nozzle channel structure that is arranged in a distance from the bottom, in this context they both are arranged at the bottom of the supply air device.

Furthermore, it may be possible to adjust the nozzles to blow towards sides i.e. the outer walls of the supply air device or towards a circulation air opening i.e. the center part of the supply air device.

The outflow channel structure comprises outflow channels, for example, 1-4 channels that guide the air mix from the supply air device to the room. A supply air device may comprise an outflow channel in its each side or in 1 to 3 of its sides. The air mix comprises primary air and secondary air. The primary air is supplied by nozzles towards the outflow channel(s) and the secondary air is entrained by the primary air from the room. The outflow channel is arranged inside the supply air device so that the first end of the outflow channel is arranged in a first distance from the nozzles, substantially under the nozzles if the supply air device is fixed to a ceiling and so that the plurality of nozzles supply the primary air towards the first end of the outflow channel and in a second distance from a side of the supply air device. A mixing chamber is formed between the plurality of nozzles and the first end of the outflow channel. The second end of the outflow channel is arranged outside the supply air device. The side of the supply air device is one of the substantially vertical walls of the supply air device, when the device is fixed to the ceiling. The height of the area between the nozzle structure and the outflow channel that is the mixing chamber may be called a vertical distance. The distance between the side of the supply air devices and the outflow channel may be called a horizontal distance.

The second end of the outflow channel may be turned away from the supply air device for supplying air mix to the side of the supply air device or it may be directed downwardly for supplying air mix towards the floor, or anything in between.

It is also possible that the width of the second end of the outflow channel is wider so that the air may be supplied to the wider area. Despite the wider width of the second end of the outflow channel, the cross-sectional area of the second end of the outflow channel is the same or at least substantially the same as the cross-sectional area of the first end of the outflow channel. In other words, the cross-sectional area of the outflow channel remains constant over the entire length of the outflow channel, wherein the cross-sectional area is the area of the outflow channel that is perpendicular to the air flow flowing in the outflow channel. This means that if the width of the second end of the outflow channel is wider than the width of the first end of the outflow channel, the height of the second end of the outflow channel is smaller than the height of the first end of the outflow channel.

It is also possible that the shape of the cross-section of the outflow channel changes. For example, the shape of the cross-section of the second end of the outflow channel and/or the shape of the middle part of the outflow channel may be different than the shape of the cross-section of the first end of the outflow channel, or the shape of the cross-section of the first end of the outflow channel and/or the shape of the middle part of the outflow channel may be different than the shape of the cross-section of the second end of the outflow channel. Despite the changed shape of the cross-section, the cross-sectional area of the outflow channel remains constant or substantially constant throughout the length of the outflow channel.

FIG. 1 shows a cross-sectional view of a prior art supply air device 10 arranged to be installed in a ceiling or wall of a room. Primary air is led via a supply air duct 11 to a supply air chamber 12 of the supply air device 10 from the outside of the device 10, normally from a central ventilation system. From the supply air chamber 12 the primary air is led through air nozzles 13 into a mixing chamber 14 located inside the supply air device 10, at a relatively high rate. The primary air flow blown into the mixing chamber 14 entrains secondary air 16 from the room through a circulation air opening 15 to the supply air device 10 and further to the mixing chamber 14. In the mixing chamber 14 primary air and secondary air 16 will be mixed. From the mixing chamber 14, the mixture of primary air and secondary air flows into the room.

Without an outflow structure according to the invention, the air circulation effectiveness may not be as effective as when an outflow structure with outflow channels is used, because the secondary air is not entrained by the primary air as effectively.

Figure 2A:
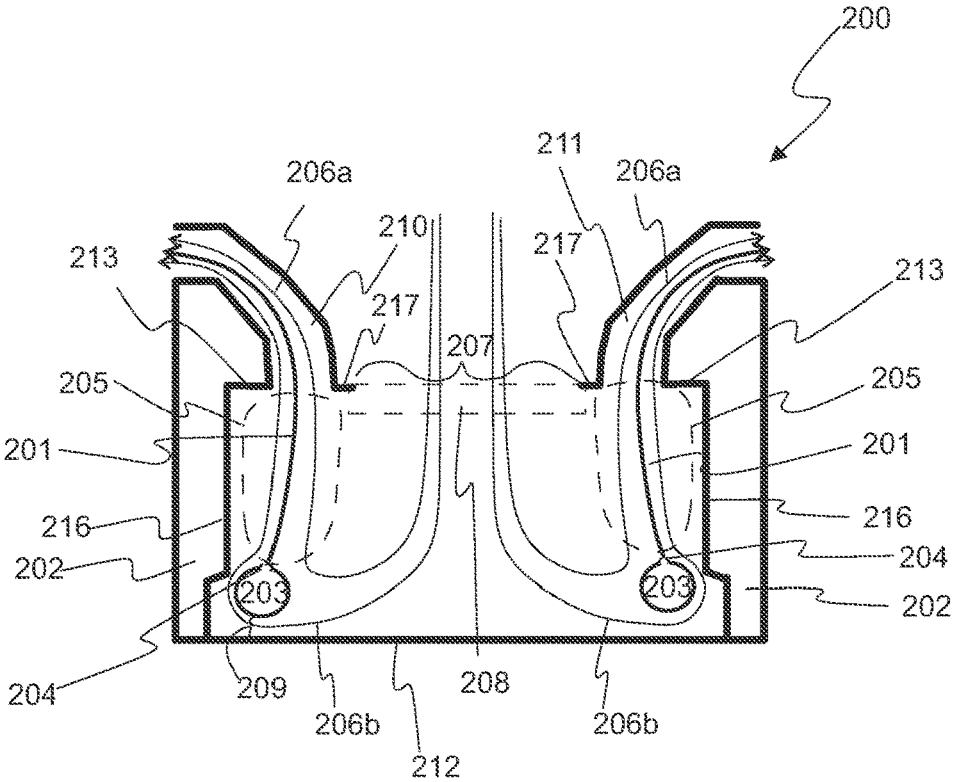
FIG. 2*a-b* show a cross-sectional view of a supply air device according to an example embodiment.

FIG. 2*a* shows a cross-sectional view of a supply air device 200 according to an example embodiment. FIG. 2*a* also shows an example route of air circulation inside the supply air device 200. Primary air 201 is led into the supply air device 200 via a supply air duct (not shown). Inside the supply air device 200 primary air 201 is led into a supply air chamber 202. From the supply air chamber 202 the primary air 201 is led to a nozzle channel structure 203 comprising a plurality of air nozzles 204. From the nozzle channel structure 203 the primary air 201 is led through air nozzles 204 to a mixing chamber 205. The primary air 201 blown into the mixing chamber 205 entrains secondary air 206*a*, 206*b* into the supply air device 200 from a room through a circulation air opening 207. The supply air device 200 comprises a filter 208 through which the secondary air 206*a*, 206*b* flows before flowing to the mixing chamber 205. In the supply air device 200, the second part of the secondary air 206*b* may also circulate to the other side of flows 201 provided by the nozzles 204 through the circulation space 209 between the bottom 212 of the supply air device 200 and the nozzle channel structure 203. The first part of the secondary air 206*a* may not circulate through the circulation space 209, but is directly entrained. The possibility to flow also to the other side of air flows 201 provided by the nozzles 204 increases the entrainment and therefore the amount of the secondary air 206*a*, 206*b*. From the mixing chamber 205, the mixture of primary air 201 and filtered secondary air 206*a*, 206*b* flows to the outflow channels 210, 211.

Figure 2B:
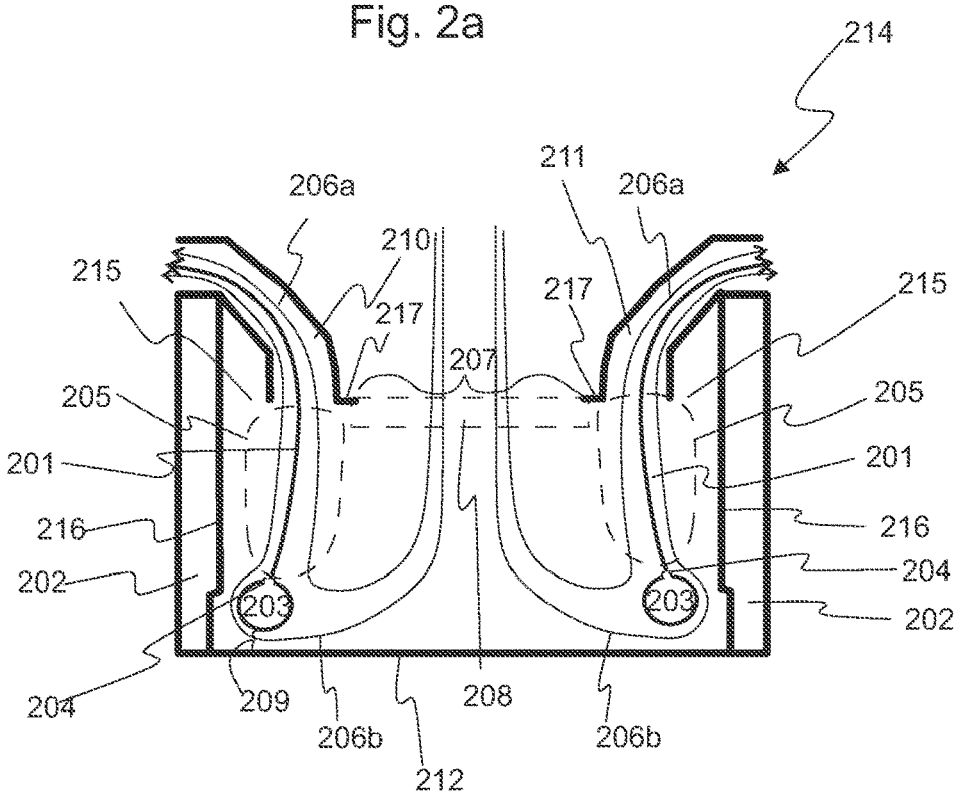
Figure 3:
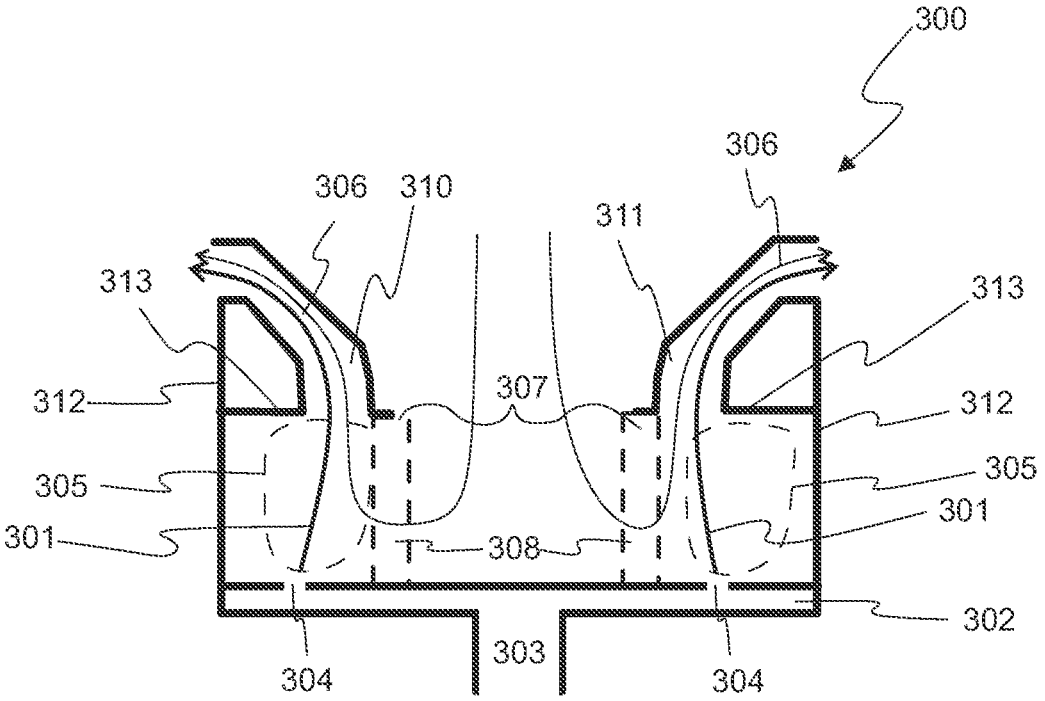
FIG. 3 shows a cross-sectional view of a supply air device according to an example embodiment.

As can be seen from FIG. 2*a*, there is a distance in the horizontal direction between the outflow channels 210, 211 and side walls 216 of the air supply device 200. This distance may be called a notch 213. In the embodiment of FIG. 2*a*, the notch 213 is between the inner side walls 216 of the supply device 200 and the outflow channels 210, 211. However, in some embodiments, the notch may be between outer side walls of a supply air device and outflow channels. This kind of structure is shown in FIG. 3. Furthermore, in the embodiment of FIG. 2*a* the notch 213 is a covered structure i.e. there is a plate, a cover or a lid or the like between the distance between the outflow channels 210, 211 and side walls 216 of the air supply device 200, but it is also possible that the notch is not covered. This kind of non-covered notch is shown in FIG. 2*b*. FIG. 2*b* corresponds to FIG. 2*a* otherwise, but the supply air device 214 have non-covered notches 215. In other words, the notch is the distance between an outflow channel and a wall, and the notch may be covered, non-covered, partially covered, inclinedly covered etc. It is also possible that there is also an additional notch 217 on the other side of the outflow channel 210, 211. These notches 217 are formed between the outflow channel 210, 211 and the circulation air opening 207.

Outflow channels 210, 211 improve circulation effectiveness which therefore improves removal of impurities from room air, if a filter is used, and/or temperature controlling, heating or cooling, of room air, if the supply air device is equipped with a heat exchanger, for example, heating or cooling coil.

FIG. 3 shows a cross-sectional view of a supply air device 300 according to an example embodiment. FIG. 3 also shows an example route of air inside the supply air device 300. Primary air 301 is led into the supply air device 300 via a supply air duct 303. Inside the supply air device 300 primary air 301 is led into a supply air chamber 302. From the supply air chamber 302 the primary air 301 is led through a plurality of air nozzles 304 to a mixing chamber 305. The primary air 301 blown into the mixing chamber 305 entrains secondary air 306 from a room through a circulation air opening 307 into the supply air device 300. The supply air device 300 comprises a filter 308 through which the secondary air 306 flows before entering the mixing chamber 305. From the mixing chamber 305, the mixture of primary air 301 and filtered secondary air 306 i.e. air mix flows to the outflow channels 310, 311. There is a distance between the outflow channels 310, 311 and side walls 312 of the air supply device 300. This distance is a notch 313 and it is formed between outer side walls 312 of the supply device 300 and the outflow channels 310, 311.

Figure 4A:
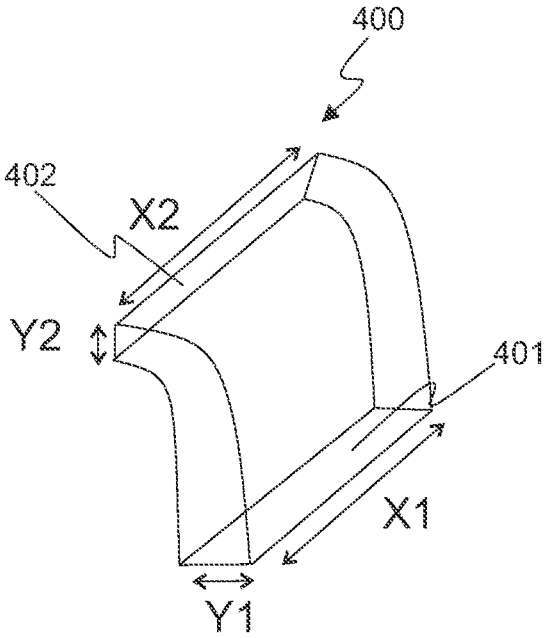
FIG. 4*a-b* show an outflow channel according to an example embodiment.

FIG. 4*a* shows a cross-sectional view of an outflow channel 400 according to an example embodiment. The first end 401 of the outflow channel 400 is arranged to be fastened to a supply air device inside the supply air device and the second end 402 of the outflow channel 400 is arranged to supply air from a mixing chamber of the supply air device out of the supply air device, for example, to a room. The width of the second end 402 of the outflow channel 400 in the horizontal direction is arranged wider than the width of the first end 401 of the outflow channel 400 in the horizontal direction. The width of the second end 402 of the outflow channel 400 is marked by X2, whereas width of the first end 401 of the outflow channel 400 is marked by X1 and X2>X1. Because the width of the second end 402 is bigger than the width of the first end 401, the height of the second end 402 in the vertical direction should correspondingly be smaller than the height of the first end 401 in the vertical direction in order to keep the cross-sectional area constant. Therefore, the height of the second end 402 is Y2 and the height of the first end 401 is Y1 and Y2<Y1. Further, (X1)*(Y1)=X2*Y2. The cross-sectional area is constant over the entire of length the outflow channel 400. The length of the outflow channel 400 from the first end to the second end may vary. It may depend, for example, on the dimensions of the supply air device.

Figure 4B:
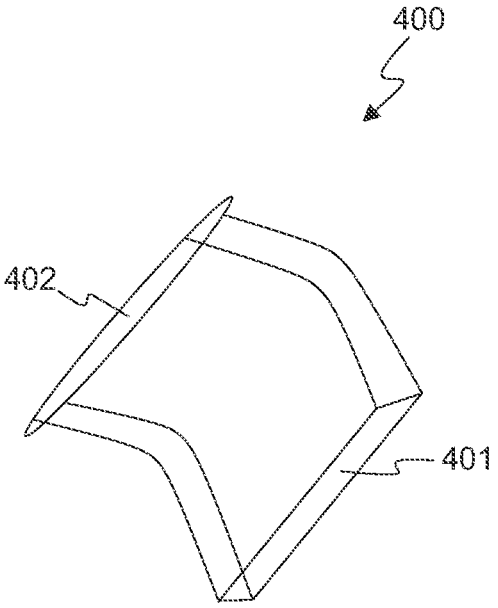

FIG. 4*b* shows a cross-sectional view of an outflow channel 400 according to an example embodiment. The shape of the cross-section of the second end 402 of the outflow channel 400 is elliptical and the shape of the cross-section of the first end 401 of the outflow channel 400 is rectangular. The cross-sectional area is constant over the entire length the outflow channel 400.

Figure 5A:
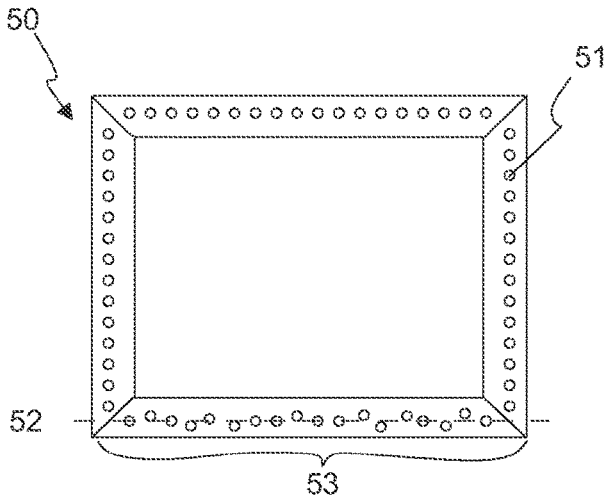
FIG. 5*a-e* show nozzle channel structures according to example embodiments.

FIG. 5*a* shows a nozzle channel structure according to an example embodiment. The nozzle channel structure 50 has a shape of a rectangle and it comprises a plurality of nozzles 51 at each side of the rectangle. Locations of nozzles relative to the longitudinal line of one or more parts of the nozzle channel structure 50 can vary. In this embodiment, locations of nozzles relative to the longitudinal line 52 of one side/part of the nozzle channel structure 53 vary.

Figure 5B:
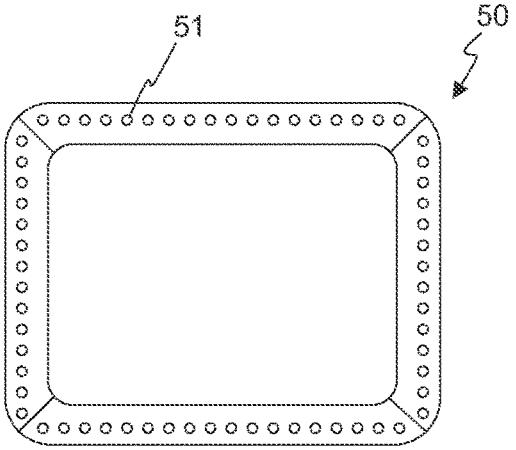

FIG. 5*b* shows a nozzle channel structure according to an example embodiment. This nozzle channel structure 50 has a shape of a rectangle with round corners and it comprises a plurality of nozzles 51. Each nozzle channel structure 50 of FIGS. 5*a* and 5*b* comprises one or more supply air openings. Via one or more supply air openings the primary air is led to the nozzle channel structure 50 from a supply air chamber or directly from a supply air duct.

Figure 5C:
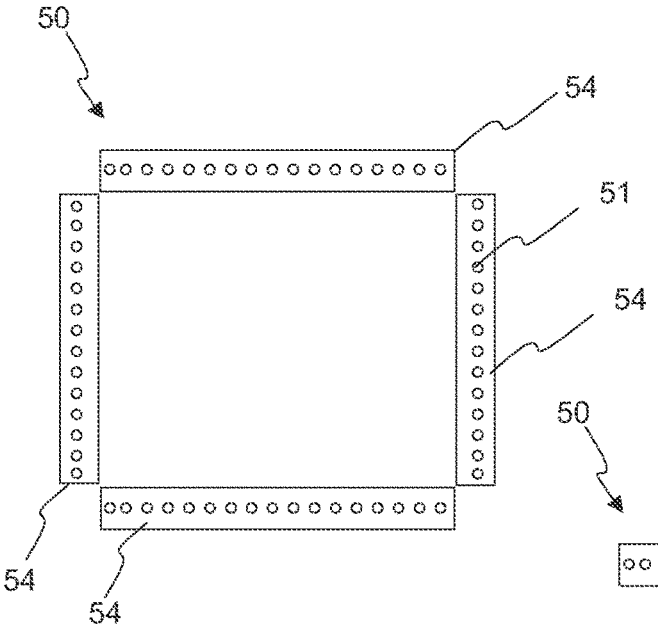

FIG. 5*c* shows a nozzle channel structure according to an example embodiment. This nozzle channel structure 50 has separate ducts 54, which are not connected to each other. Each duct comprises one or more supply air openings. Via one or more supply air openings the primary air is led to each duct 54 of the nozzle channel structure 50 from a supply air chamber or directly from a supply air duct. Also this nozzle channel structure comprises a plurality of nozzles 51. The ducts 54 may have one open end or both ends may be open. The ducts 54 may be connected together by corner pieces so that the air can flow from one duct 54 to at least one other duct 54 or the ducts 54 may be such that they are not connected to each other.

Figure 5D:
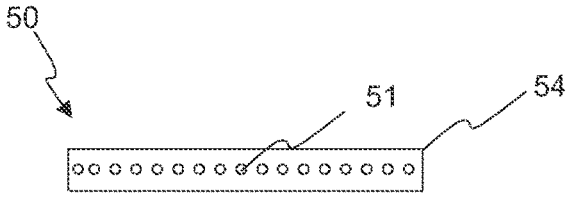
Figure 5E:
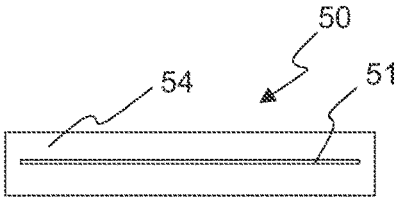

FIGS. 5*d* and 5*e* show a nozzle channel structure according to an example embodiment. These nozzle channel structures 50 are formed from a duct 54 having a straight shape. The nozzle channel structure 50 of FIG. 5*d* comprises a plurality of nozzles 51 and the nozzle channel structure 50 of FIG. 5*e* comprises a slit nozzle 51. If a supply air device comprises this kind of nozzle channel structure or nozzles which are arranged correspondingly to the bottom of the supply air device, the supply air device may comprise an outflow channel structure that comprises only one outflow channel towards which the primary air is supplied.

Figure 6:
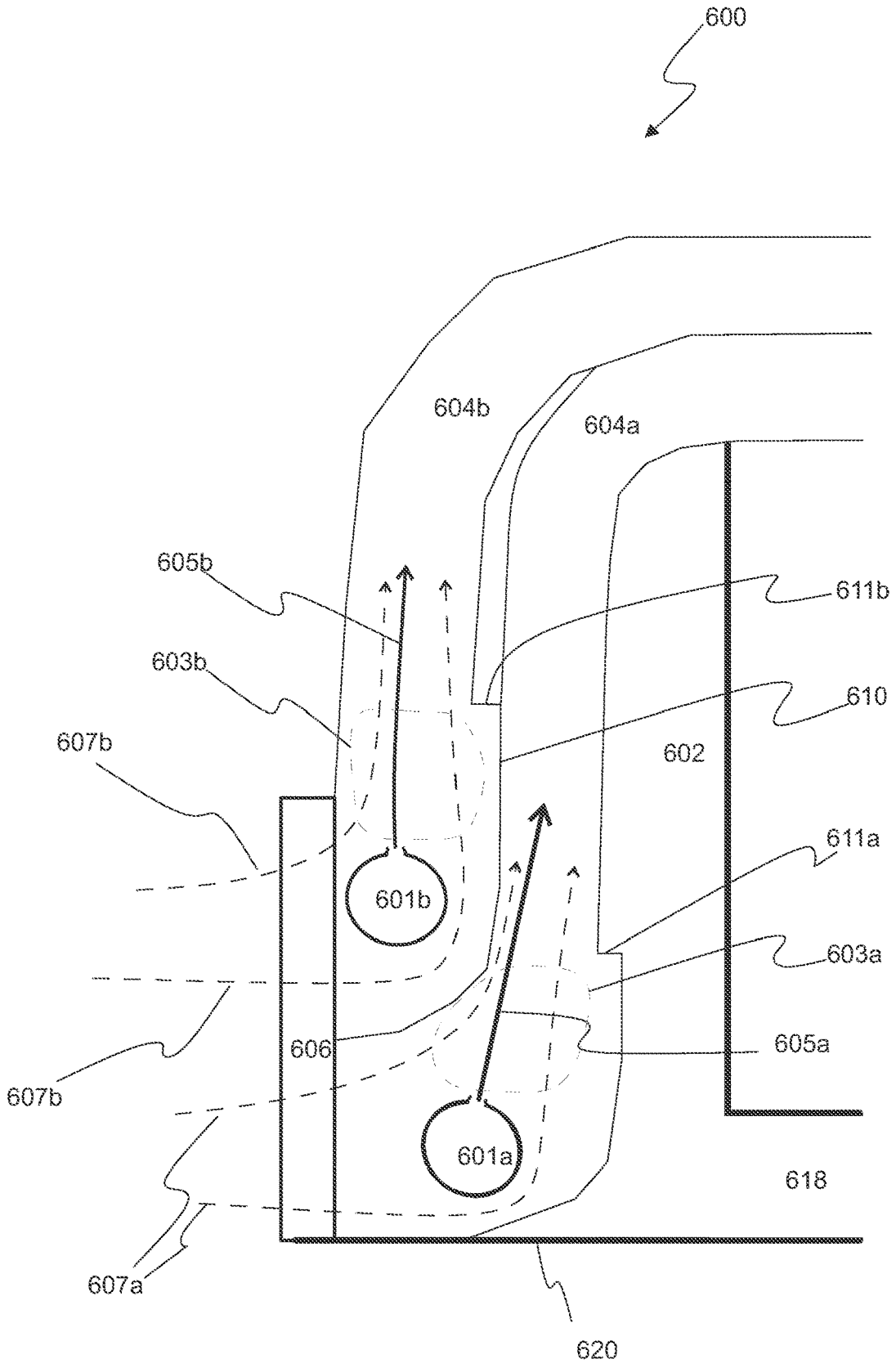
FIG. 6 shows a simplified cross-sectional view of a part of a supply air device comprising a double outflow structure according to an example embodiment.

FIG. 6 shows a simplified cross-sectional view of a part of a supply air device 600 comprising a double outflow structure according to an example embodiment. The double outflow structure comprises two nozzle channel structures 601*a*, 601*b* and two outflow channels 604*a*, 604*b*. Nozzle channel structures 601*a*, 601*b* are arranged so that the first is closer to the bottom of the supply air device 600 than the second one. Both nozzle channel structures 601*a*, 601*b* comprise their own mixing chambers 603*a*, 603*b*. There is a separating wall 610 between the mixing chambers 603*a*, 603*b*. Again these nozzle channel structures 601*a*, 601*b* may have any suitable shape, for example, a rectangular. They may even have different shapes, if they, for example, fit inside the supply air device 601 better that way. However, a supply air device 600 may also comprise one or more than two nozzle channel structures with outflow channels, for example, 3, 4, or 5.

The first nozzle channel structure 601*a*, the lower one in this figure, is again arranged at a distance from the bottom 620 of the supply air device 600 and the second nozzle channel structure 601*b* is attached at a distance from a bottom part of the separating wall 610. The bottom part of the separating wall 610 is the part of the separating wall 610 that is under the second nozzle channel structure 601*b*. The supply air device 600 comprises also a filter 606. Primary air may be led into the supply air device 600 via a supply air duct 618 from a central ventilation system, a room, outside etc. In the supply air device 600 primary air is led into a supply air chamber 602. From the supply air chamber 602 the primary air is led to the nozzle channel structures 601*a*, 601*b* comprising a plurality of air nozzles. From the nozzle channel structures 601*a*, 601*b* the primary air is led through air nozzles of the nozzle channel structures 601*a*, 601*b* into the mixing chambers 603*a*, 603*b* as primary air flows 605*a*, 605*b*. The primary air flows 605*a*, 605*b* blown into the mixing chambers 603*a*, 603*b* entrain secondary air 607*a*, 607*b* into the supply air device 600 from the room wherein the supply air device 600 lies through a circulation air opening. Inside the supply air device 600 the secondary air 607*a*, 607*b* flows through the filter 606 on its way to the mixing chambers 603*a*, 603*b*. A part of the secondary air 607*a*, 607*b* may circulate through the circulation spaces between the first nozzle channel structure 601*a* and the bottom of the device 600 or through the circulation space between the second nozzle channel structure 601*b* and the bottom part of the separating wall 610 before they mix with the primary air of primary air flows 605*a*, 605*b* in the mixing chambers 603*a*, 603*b*. From the mixing chambers 603*a*, 603*b*, the mixture of primary air and filtered secondary air flows to the outflow channels 604*a*, 604*b* and through them out of the device 600. Before entering to the outflow channels 604*a*, 604*b* there are notches 611*a*, 611*b*, which also guide the air mix to the outflow channels 604*a*, 604*b*. Again the structure of the supply air device 600 comprising the nozzle channel structures 601*a*, 601*b* and the mixing chambers 603*a*, 603*b*, but also the outflow channels 604*a*, 604*b* and the notches 611*a*, 611*b* increase the air circulating efficiency of the supply air device 600.

Figure 7:
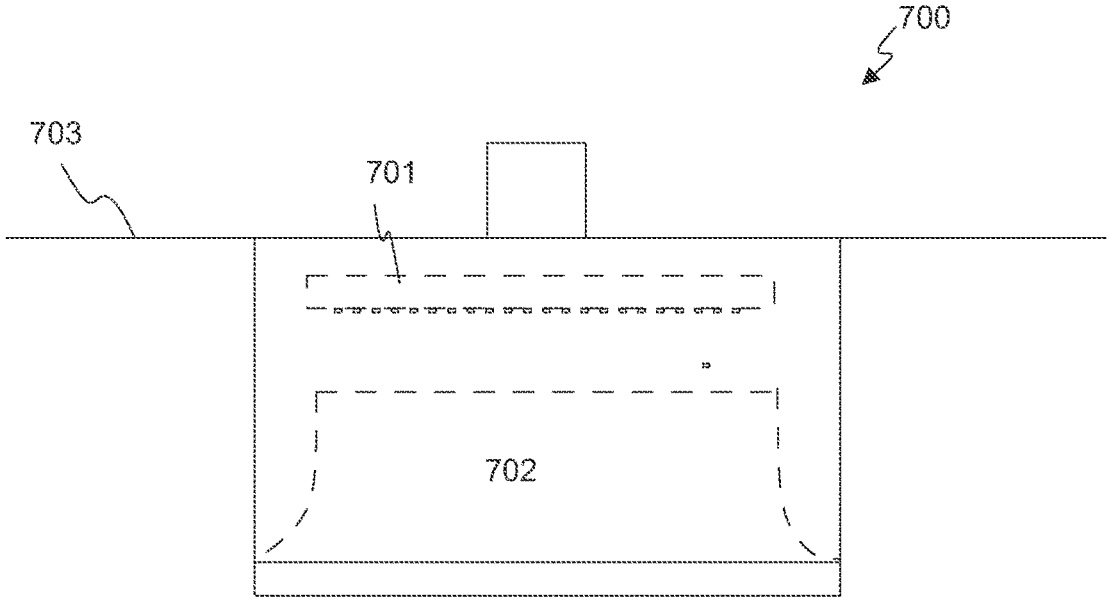
FIG. 7 shows a side view of a supply air device according to an example embodiment.

FIG. 7 shows a side view of a supply air device 700 according to an example embodiment. This FIG. 7 shows how a nozzle structure 701 and an outflow channel 702 are located relative to one another inside the device 700, when the device is fixed to the ceiling 703 and how the width of the outflow channel 702 is increased in the second end and how the second end is turned away from the device 700 for supplying air to the side of the device 700.

Figure 8:
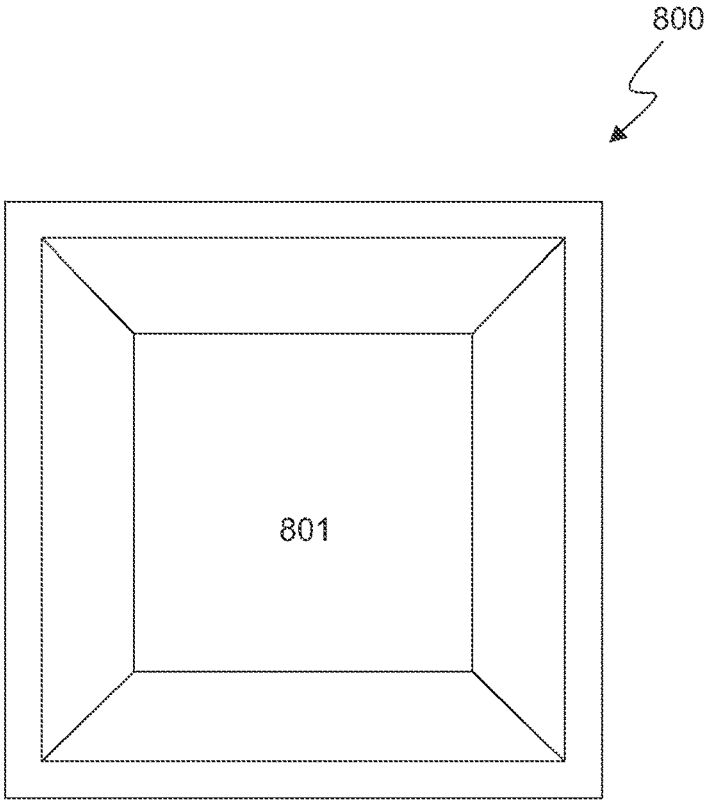
FIG. 8 shows a uniform outflow channel structure according to an example embodiment from below.

FIG. 8 shows a uniform outflow channel structure 800 according to an example embodiment from below i.e. from the side whereto the air flows from a supply air device into which the outflow channel structure 800 is connected. There are no dividing walls in the air flowing direction in the outflow channel structure 800. Instead, each side of the outflow channel structure 800 that is an outflow channel is connected to the adjacent outflow channel of the outflow channel structure 800 so that the airflow channels together form an unobstructed structure perpendicular to the air flowing direction inside the outflow channel structure 800. The uniform outflow channel structure 800 continuously surrounds as a rectangular structure a secondary air opening when the outflow channel structure 800 is arranged in a supply air device. The outflow channel structure 800 of this embodiment has the second end that is directed downwardly towards the floor. The cross-sectional area of the outflow channel structure remains constant over the entire outflow channel structure. It is possible that the outflow channel structure 800 comprises one or more dividing walls. The outflow channel structure 800 may however have a second end that is directed to sides instead the floor.

Figure 9A:
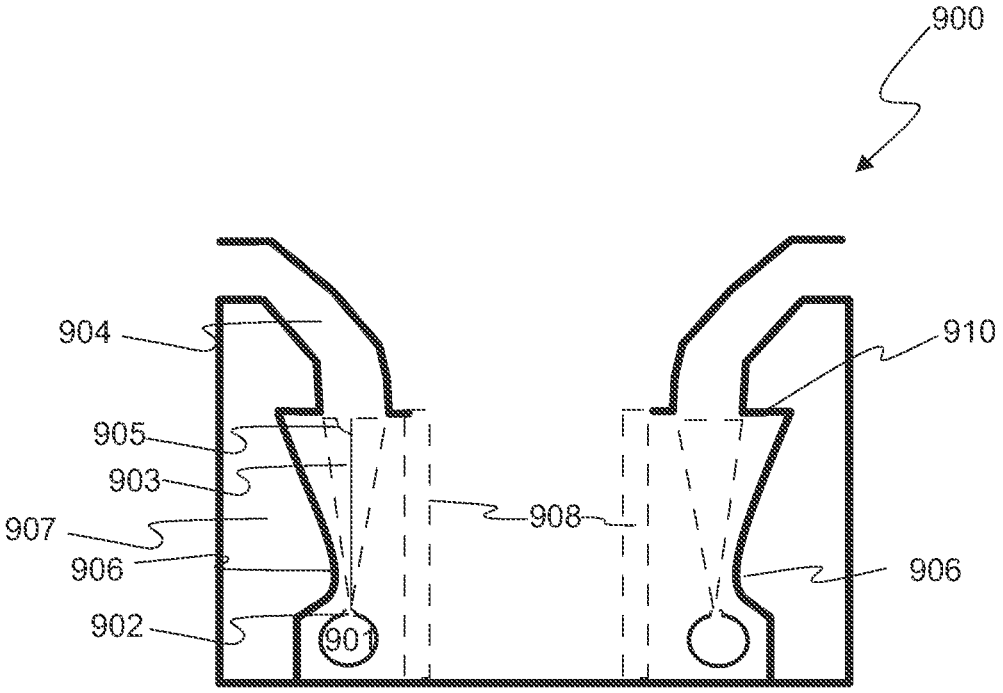
FIG. 9*a* shows a cross-sectional view of a supply air device according to an example embodiment.

FIG. 9*a* shows a cross-sectional view of a supply air device 900 according to an example embodiment. Also in this supply air device 900, primary air is led into the supply air device 900 via a supply air duct (not shown). Inside the supply air device 900 primary air led into a supply air chamber 907. From the supply air chamber 907 the primary air is led to a nozzle channel structure 901 comprising at least one or a plurality of air nozzles 902. From the nozzle channel structure 901 the primary air is led through air nozzles 902 to a mixing chamber. The primary air blown into the mixing chamber as air flows entrains secondary air into the supply air device 900 from a room or other space wherein the supply air device is located. The air flows have a shape of an air jet 903 widening when flowing from the nozzle 902 towards the outflow channel 904. The possible opening angle 905 of widening air jets 903 may be around 12°. The supply air device 900 also comprises a filter 908 through which the secondary air flows to the mixing chamber. Inside the supply air device 900, the second part of the secondary air may also circulate to the other side of air flows provided by the nozzles 902 through the circulation space between the bottom of the supply air device 900 and the nozzle channel structure 901. The first part of the secondary air may not circulate through the circulation space, but is directly entrained. From the mixing chamber, the mixture of primary air and filtered secondary air flows to the outflow channel 904. The cross-sectional area of the outflow channel 904, which is perpendicular to the air flow of the outflow channel, remains constant, and the second end of the outflow channel is wider in the vertical direction and narrower in the horizontal direction than the first end of the outflow channel that is the end that is closer to the nozzles 902.

When compare the supply air device 900 of FIG. 9*a* to supply air devices of other example embodiments of this invention, the supply air chamber of the supply air device 900 is an indented supply air chamber 907. This means that, at least one inner wall of the indented supply air chamber is shaped so that an indent 906 is formed. The indent 906 is a protrusion. The indent 906 is towards the interior of the supply air device. Due this indent 906 the volume of the supply air chamber 907 increases. The indent 906 is formed so that its surface follows the shape of the air jet 903 widening towards the outflow channel 904, therefore the indent 906 becomes smaller when closing the outflow channel 904 i.e. the inner wall of the supply air chamber 907 approaches the out wall of the supply air device 900 when it nears the outflow channel 904. The shape of the indents 906 of this FIG. 9*a* is round cornered. It should be noted that all inner walls of the indented supply air chamber may comprise indents. For example, if the supply air device 900 has a rectangular structure, and all four sides of it comprise a supply air chamber or there is a common supply air chamber for four sides, each inner wall of the indented supply air chamber may comprise an indent.

The supply air device 900 also comprises a notch 910 formed to the inner of the side supply air chamber 907. In this embodiment of FIG. 9*a* the notch 910 is covered. In this example embodiment, the notch 910 is the distance between the outflow channel 904 and the wall of the supply air chamber 907 comprising the indent 906. There is also an additional notch on the other side of the outflow channel 904.

Figure 9B:
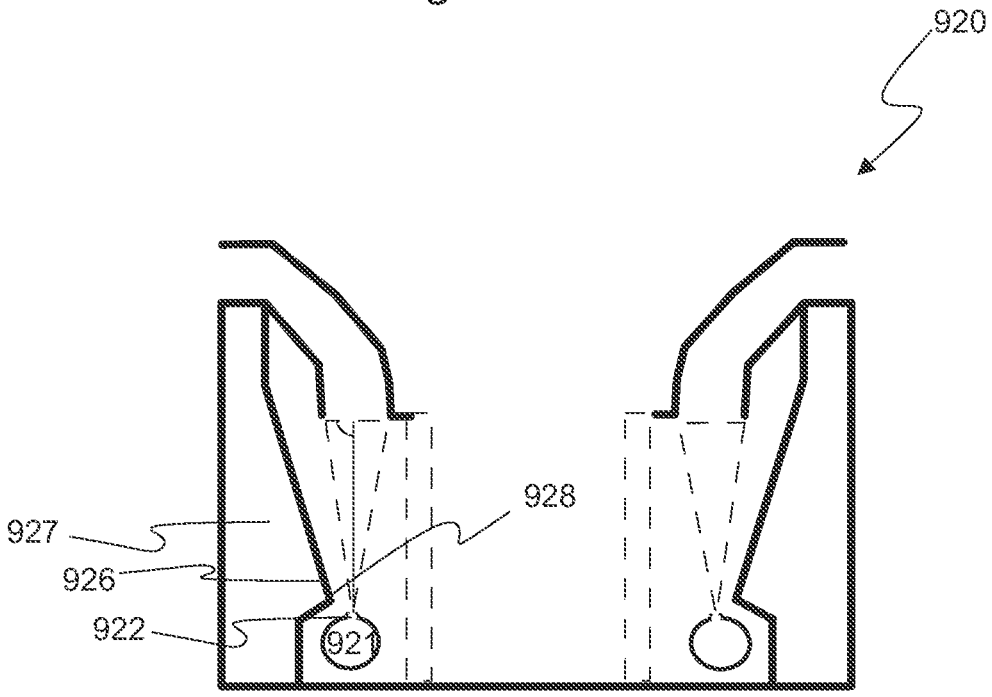
FIG. 9*b* shows a cross-sectional view of a supply air device comprising an indented supply air chamber according to an example embodiment.

FIG. 9*b* shows a cross-sectional view of a supply air device 920 comprising also an indented supply air chamber 927 according to an example embodiment. In this embodiment, the indented 926 is not round cornered, but it comprises an angle 928 towards the interior of the device 920. The idea of the angle 928 is to prevent the coanda effect. Due this coanda effect an air flow would normally be entrained by a wall, which in this embodiment is the wall of the supply air chamber 927 comprising the indent 926. This coanda effect should not jet be happened in this part of the device 920, because the air flow have widening shape and the shape should not be widen enough to reach the wall, but if, for some reason, the air flows along the wall, the angle 928 would disconnect the air from the wall comprising the indented 926.

The indented supply air chamber shown in FIGS. 9*a* and 9*b* increases the volume of the supply air chamber, as already mentioned, which decreases the counter pressure caused supply air chamber, which in turn also increases the air circulating efficiency of the supply air device, causes less noise, and consume less energy.

A device comprising an outflow structure according to the invention may increase the secondary air flow even more by increasing entrainment of the secondary air and increasing exhaustion in the mixing chamber and/or in the outflow channel so that the amount of the secondary air increases, thereby enhancing the purification or temperature controlling of air in the room, than a device comprising only one outflow structure. However, the device comprising one outflow structure according to the invention may entrain the secondary air flow still more than prior art solutions.

It should be also noted that it is possible to use a supply air device comprising an outflow structure according to the invention also for other gases than air.

It is obvious that the present invention is not limited solely to the above-presented embodiments, but it can be modified within the scope of the appended claims.

The invention claimed is:

1. A supply air device comprising:

an outflow structure comprising a nozzle structure and an outflow channel structure, wherein the nozzle structure comprises a plurality of nozzles which at least in part are arranged at a bottom of the supply air device for supplying a primary air, and wherein the outflow channel structure comprises at least one outflow channel, a first end of which is arranged at a first distance from said plurality of nozzles so that a mixing chamber is formed between said plurality of nozzles and the first end of the at least one outflow channel and so that said plurality of nozzles supply the primary air towards the first end of the at least one outflow channel and wherein said primary air entrains a secondary air from outside the supply air device to flow to the mixing chamber to be mixed with the primary air in the mixing chamber before the primary air and the secondary air enter the at least one outflow channel through the first end of the at least one outflow channel and flow out of the supply air device through a second end of the at least one outflow channel, wherein the first end of the at least one outflow channel is arranged to have at least one notch in a direction out of and substantially perpendicular to a directly abutting wall of the at least one outflow channel with the notch forming substantially 90° angle with the directly abutting wall of the at least one outflow channel at the first end, to increase an air circulating efficiency, and wherein a cross-sectional area of the at least one outflow channel, which is perpendicular to an air flow in the at least one outflow channel, remains constant along a length of the outflow channel.

2. The supply air device according to claim 1, wherein the second end of the at least one outflow channel is turned away from the supply air device.

3. The supply air device according to claim 1, wherein the second end of the at least one outflow channel is directed downwards.

4. The supply air device according to claim 1, wherein the outflow channel structure is a uniform and unobstructed structure perpendicular to an air flowing direction in the outflow channel structure.

5. The supply air device according to claim 1, wherein the outflow channel structure comprises two outflow channels.

6. The supply air device according to claim 1, wherein the nozzle structure is a nozzle channel structure arranged at least in part at a distance from the bottom of the supply air device forming a circulation space between the bottom of the supply air device and the nozzle channel structure.

7. The supply air device according to claim 1, wherein the nozzle structure comprises all of the plurality of nozzles arranged at the bottom of the supply air device.

8. The supply air device according to claim 1, wherein the supply air device further comprises at least one filter for filtering the secondary air coming to the supply air device.

9. The supply air device according to claim 1, wherein the at least one outflow channel comprises at least two outflow channels, wherein the supply air device comprises two or more nozzle channel structures with separate outflow channels of the at least two outflow channels.

10. The supply air device according to claim 1, wherein the supply air device further comprises an indented supply air chamber, which inner wall is shaped so that an indent is formed towards an interior of the air supply device, and wherein the surface of the indent follows the shape of the primary air flows arranged to be supplied by the plurality of nozzles and having a shape of widening air jet.

11. The supply air device according to claim 10, wherein the indent is round cornered.

12. The supply air device according to claim 10, wherein the indent comprises an angle.

13. The supply air device according to claim 1, wherein the second end of the at least one outflow channel is wider in a widest direction of a cross section of the at least one outflow channel at the second end and is narrower in a narrowest direction in the cross section of the second end than in corresponding widest and narrowest directions at the first end of the outflow channel.

14. The supply air device according to claim 1, wherein the first end of at least one outflow channel is arranged at a second distance from an inner side of the supply air device so that the at least one notch is formed between the at least one outflow channel and the inner side.

15. The supply air device according to claim 1, wherein the second end of the at least one outflow channel is directed substantially 90° to a direction of the first end of the at least one outflow channel.

16. The supply air device according to claim 15, wherein the first end of the at least one outflow channel is substantially perpendicular to the bottom of the supply air device, and the second end of the at least one outflow channel is substantially parallel to the bottom of the supply air device.

* * * * *